United States Patent [19]

Bode et al.

[11] Patent Number: 4,833,827

[45] Date of Patent: May 30, 1989

[54] ROTATING DRIVE MECHANISM FOR OPERATING THE WING OF A SWINGING DOOR, ESPECIALLY OF A VEHICLE

[75] Inventors: Jurgen Bode, Kassel; Manfred Horn, Kaufungen, both of Fed. Rep. of Germany

[73] Assignee: Gebr. Bode & Co. GmbH, Kassel, Fed. Rep. of Germany

[21] Appl. No.: 158,183

[22] Filed: Feb. 19, 1988

[30] Foreign Application Priority Data

Feb. 20, 1987 [DE] Fed. Rep. of Germany ..... 3705369

[51] Int. Cl.[4] ..... E05F 15/00

[52] U.S. Cl. ..... 49/280; 49/334; 49/335; 49/255

[58] Field of Search ..... 49/334, 335, 337, 280, 49/281, 255, 256

[56] References Cited

U.S. PATENT DOCUMENTS

| | | | |
|---|---|---|---|
| 4,308,691 | 1/1982 | Horn | 49/334 |
| 4,545,149 | 10/1985 | Jentsch | 49/334 |
| 4,731,886 | 3/1988 | Heinrich | 49/334 |

*Primary Examiner*—Kenneth J. Dorner
*Assistant Examiner*—Gerald A. Anderson
*Attorney, Agent, or Firm*—Sprung Horn Kramer & Woods

[57] ABSTRACT

A rotating drive mechanism for operating the wing of a swinging door, especially of a vehicle. The wing is articulated by pivoting arms to a rotating post, which it rotates along with. When the door is closed, the wing can be raised by axial displacement of the post into a locked position, where locking components on the stationary door frame and on the wing of the door engage each other. The post is driven by a strictly linear mechanism that is controlled by pressure medium and its linear motion is converted into a rotation by a helical transmission. Certain drawbacks are elminated by the improvement wherein the rotating post is coupled to the helical transmission in such a way that, at least while the wing of the door is closing, the post cannot rotate in relation to it but can move axially and, once the post has attained a specified limit of rotation while the wing of the door is closing, the linear drive mechanism will be additionally directly coupled axially to the rotating post in such a way as to lift it.

11 Claims, 6 Drawing Sheets

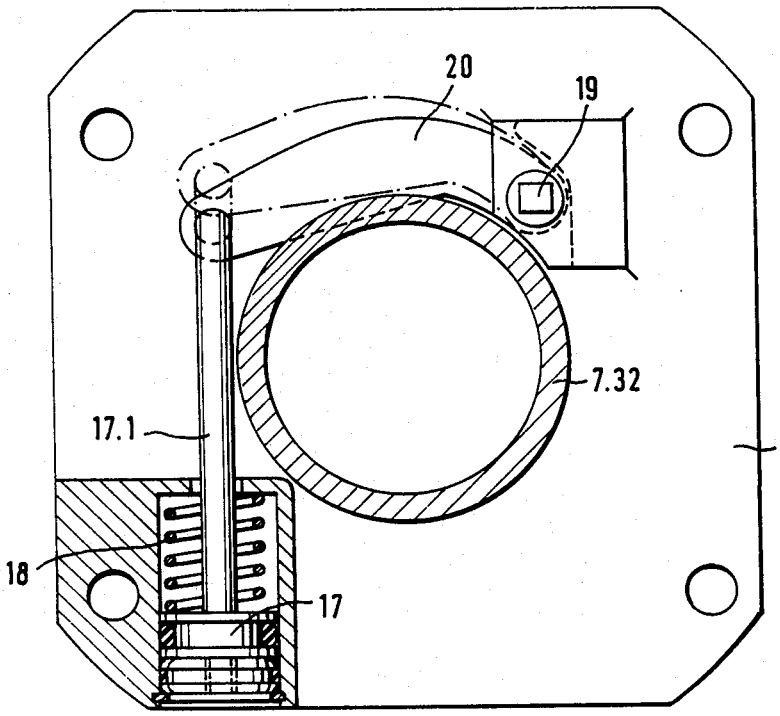
FIG. 3c
FIG. 4
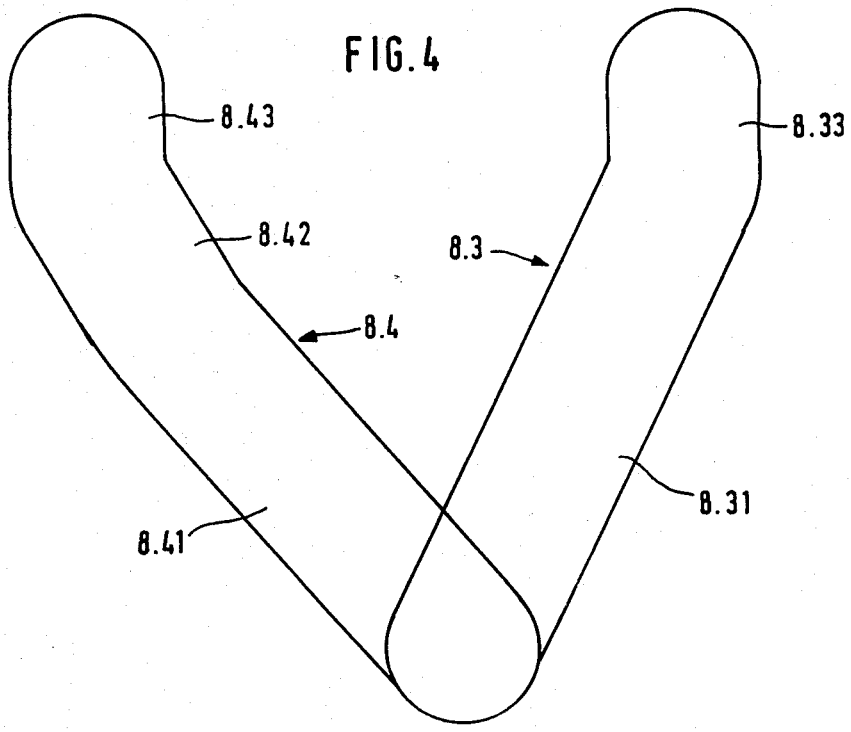

ROTATING DRIVE MECHANISM FOR OPERATING THE WING OF A SWINGING DOOR, ESPECIALLY OF A VEHICLE

BACKGROUND OF THE INVENTION

The invention relates to a rotating drive mechanism for operating the wing of a swinging door, especially of a vehicle, that is articulated by means of pivoting arms to a rotating post, which it rotates along with, and that, when the door is closed, can be raised by axial displacement of the post into a locked position, where locking components on the stationary door frame and on the wing of the door engage each other, whereby the post is driven by a strictly linear mechanism that is controlled by pressure medium and its linear motion is converted into a rotation by a helical transmission.

A rotating drive mechanism of this type is known. It is described for example in German patent No. 2 062 135.

Once the door has closed, the wing in the known drive mechanism is lifted into a locked position, where it cannot be forced open and where it will not rattle as the vehicle travels.

The rotation and axial motion of the rotating post into the position where the wing of the door is locked is produced in one embodiment of the known rotating drive mechanism by the helical transmission between the linear drive mechanism and the post. This system exploits the feature that, once the wing of the door has entered the doorway, the post can no longer rotate, so that force applied axially to the helical transmission will lift the post against the force of a spring.

There is a drawback to the known rotating drive mechanism in that the reaction torque needed to lift the door and tension the spring is considerable and must be applied through the sealing strip around the door. The resulting friction diminishes the lifting force of the drive mechanism and increases the wear on the sealing strip.

Another drawback is that, if the known rotating drive mechanism is not equipped with a reversing mechanism deriving from the lifting motion of the wing of the door, any force applied in opposition to the motion of the door as it closes for example will lift the door before it has completely closed. Once it has been lifted, however, the wing of the door will not engage the locking components, and the door will not close completely.

It is of course possible to avoid the aforesaid drawbacks as described in German patent No. 2 062 135 by employing one mechanism to swing the wing of the door and another to lift it. This approach, however, is considerably complicated and takes up more space than is normally available in vehicles in particular.

SUMMARY OF THE INVENTION

The object of the invention is to improve a rotating drive mechanism of the aforesaid type while retaining the advantage of a common mechanism to both rotate and lift the wing of the door to the extent that the aforesaid drawbacks are eliminated, whereby the lifting motion will follow the rotating motion and the wing of the door cannot be lifted until the rotating motion is complete.

This object is attained in accordance with the invention by an improvement wherein the rotating post is coupled to the helical transmission in such a way that, at least while the wing of the door is closing, the post cannot rotate in relation to it but can move axially and, once the post has attained a specified limit of rotation while the wing of the door is closing, the linear drive mechanism will be additionally directly coupled axially to the rotating post in such a way as to lift it.

Once the limiting position prescribed for the rotation has been attained with the wing of the door closed, any further swinging on the part of the wing can be dictated solely by the locking components.

The rotating post can, as it is lowered, be interlockingly coupled to the linear drive mechanism.

The rotating drive mechanism can have a mechanism for automatically locking the rotating post into the lift-termination position, in which case the locking mechanism can be released pneumatically, hydraulically, or manually.

The helical transmission can have a stator that is rigidly connected to the housing of the rotating drive mechanism, a rotating rotor that is coupled to the rotating post, and a coupling component that is connected to the linear drive mechanism and that slides back and forth axially to rotate the rotor in relation to the stator, whereby the rotating post can be coupled to the rotor in such a way that it cannot rotate with it but can move axially with it and can additionally be directly coupled to the linear drive mechanism once the coupling component has attained a prescribed position while the door is closing.

The additional direct coupling can occur by way of the coupling component or directly through the takeoff component of the linear drive mechanism.

The positioning structure betweenthe stator and the rotor ensures that the rotation is concluded before the lifting motion commences.

The locking mechanism can have a bar that pivots radially in relation to the rotating post, that, in the lift-termination position, engages subject to the force of a spring the bottom of a stop connected to the rotating post, and that is coupled to the piston rod of an unlocking cylinder.

The basic principle of the invention consists of coupling the axially movable post directly to the linear drive mechanism once the post has completed the rotation that closes the door and hence to initiate the lifting motion. The helical transmission can be designed to ensure that the wing of the door will stop rotating before the lifting motion is initiated, so that both motions will be completely independent with no need for two separate drive mechanisms.

Two embodiments of a rotating drive mechanism in accordance with the invention will now be described with reference to the drawings.

BRIEF DESCRIPTION OF THE DRAWINGS

FIG. 4 is a larger-scale illustration showing the shape of the positioning groove in the rotating drive mechanism illustrated in FIGS. 3 through 3*b*.

DETAILED DESCRIPTION OF THE INVENTION

Figure 1:
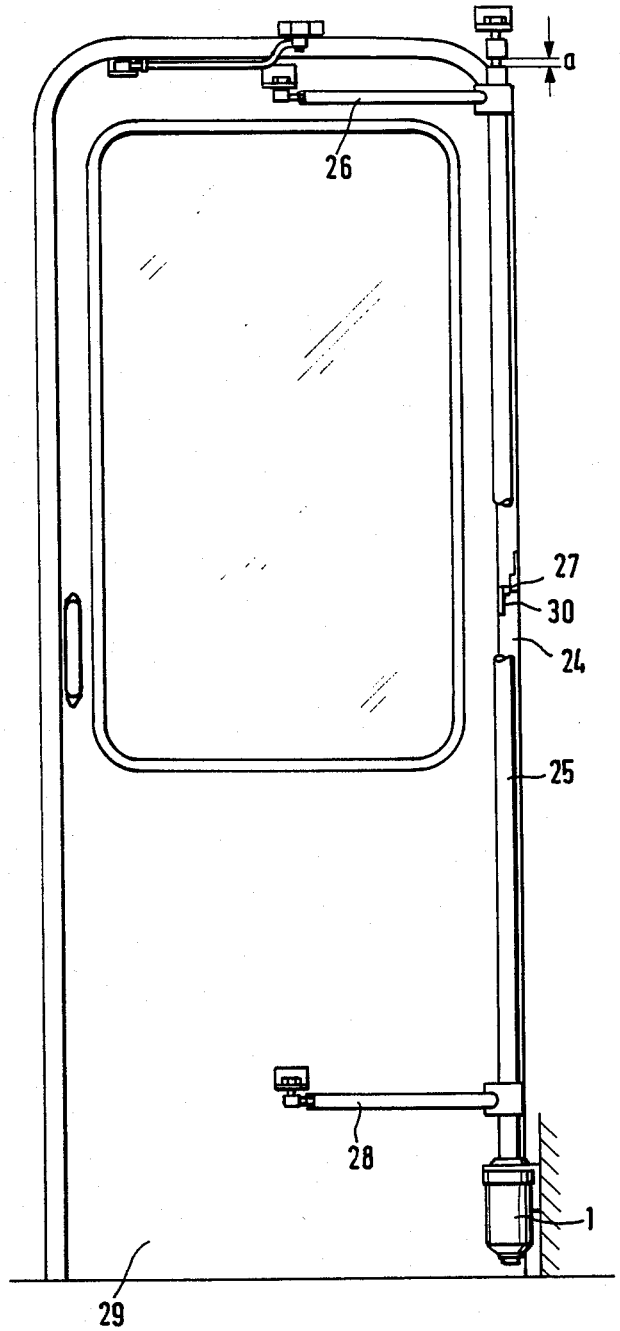
FIG. 1 is a view from inside a vehicle of the wing of a swinging door with a rotating drive mechanism.

FIG. 1 shows the wing 29 of a swinging door on a mass-transit vehicle for example. The wing is articulated by means of pivoting arms 26 and 28 to a rotating post 25 positioned upright over the floor of the vehicle. As will be described later in detail, wing 29 can be pivoted through the intermediary of rotating post 25 by a rotating drive mechanism 1 and, once the door has closed, can be lifted a distance "a" into a locked position by a straight-line motion on the part of the post. Once the wing has been lifted, locking components, which are only schematically illustrated in FIG. 1 and which may comprise for example a bolt 30 and a wedge surface 27, engage each other and lock wing 29 into a terminal position, whereby the door is completely closed.

One embodiment of rotating drive mechanism 1 will now be described in detail with reference to FIGS. 2, 2*a*, 2*b*, and 2*c*.

Figure 2:
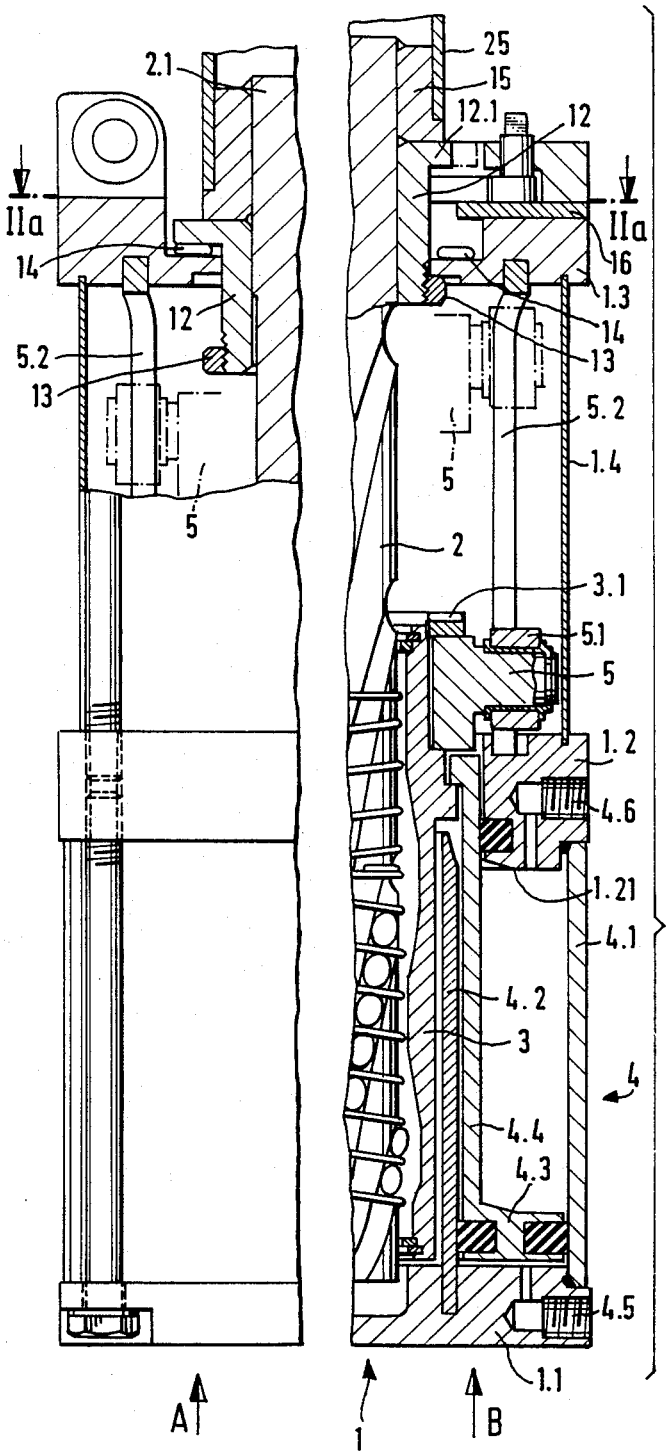
FIG. 2 is a larger-scale illustration, partly sectional longitudinally, of a rotating drive mechanism for the wing illustrated in FIG. 1.

With reference now to FIG. 2, the housing of rotating drive mechanism 1 is cylindrical and has two face caps 1.1 and 1.3 and an annular intermediate flange 1.2 along with a cylindrical jacket with grooves 5.2 that constitutes a stator and a covering sleeve 1.4. The outer wall 4.1 at the bottom of the housing is simultaneously the outer cylindrical jacket of a drive cylinder 4. Drive cylinder 4 consists of two mutually coaxially positioned cylindrical jackets 4.1 and 4.2, cylinder base 1.1, and cylinder cap 1.2. The piston 4.3 associated with the cylinder is an annular piston that slides back and forth in and seals off the gap between outer cylindrical jacket 4.1 and inner cylindrical jacket 4.2 and is connected to a tubular piston rod 4.4 that extends axially directly along inner cylindrical jacket 4.2. Piston rod 4.4 extends tightly out of drive cylinder 4 between cylinder cap 1.2 and inner cylindrical jacket 4.2 and is connected to a coupling component 3 that in the present embodiment is a long nut extending down into the inside of inner cylindrical jacket 4.2 and surrounding a threaded spindle 2 that constitutes the rotor of a helical transmission in one piece with the stub 2.1 of an outwardly extending takeoff shaft.

Coupling component 3 is also non-rotationally connected to a positioning component 5 that dictates the rotation of the coupling component while piston 4.3 is in motion during the initial and axial phase of the closing of the door. Positioning component 5 has rotating rollers 5.1 that travel in grooves 5.2, which are rigidly connected to the housing of rotating drive mechanism 1. Positioning component 5 is positioned on at least two sides of coupling component 3.

Figure 2C:
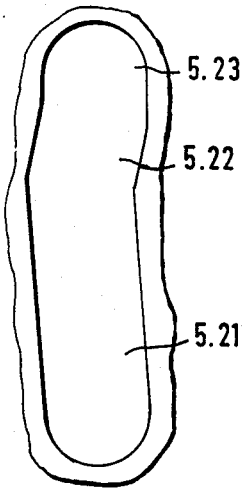
FIG. 2*c* illustrates the shape of the positioning groove in the drive mechanism illustrated in FIG. 2, FIGS. 3, 3*a*, and 3*b* are axial sections through another embodiment of a rotating drive mechanism and illustrate the different positions it assumes while the door is closing.

Grooves 5.2 have helical sections 5.21 and 5.22 at the bottom, each of which merges at the top into an axially parallel section 5.23, as shown in FIG. 2*c*.

Threaded spindle 2 is, in the vicinity of its upper end, rigidly connected to a collar 12 that, when the in principle axially displaceable threaded spindle 2 is at its lower limiting position, rests against an axial needle bearing 14 in the upper face cap 1.3 of the housing. At the bottom of collar 12 is a threaded cap 13. The bottom surface of threaded cap 13 constitutes a stop for the upper terminal surface 3.1 of coupling component 3.

Takeoff-shaft stub 2.1 is connected to rotating post 25 in such a way that they can neither rotate nor move up and down in relation to each other by means of a connector 15.

Figure 2A:
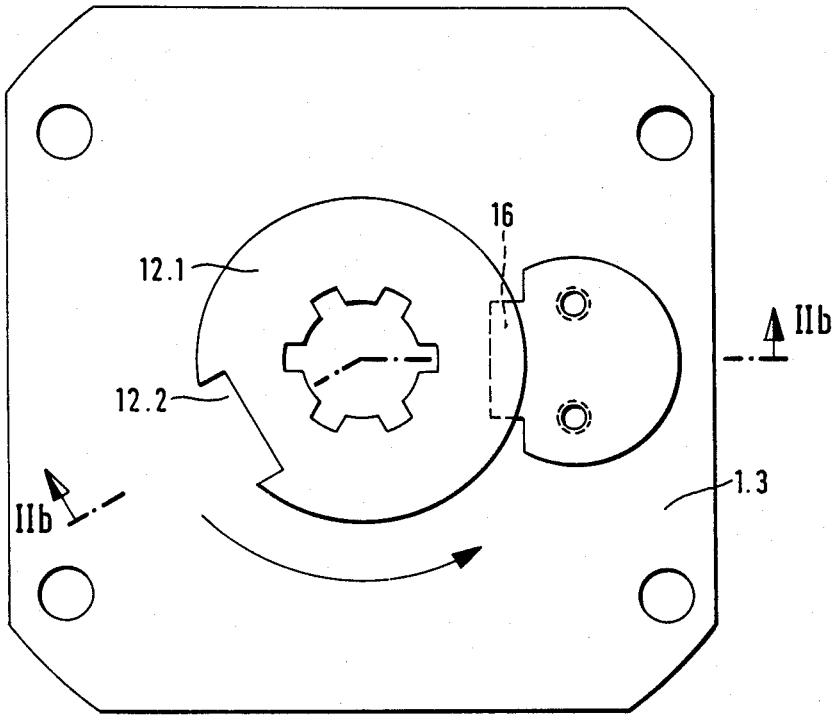
FIG. 2*a* is a section along the line II*a*—II*a* in FIG. 2.
Figure 2B:
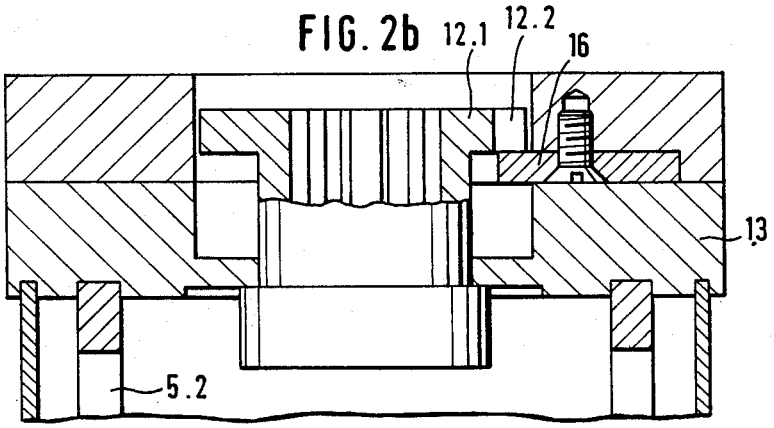
FIG. 2*b* is a section along the line II*b*—II*b* in FIG. 2*a*.

With reference now to FIGS. 2*a* and 2*b*, collar 12 has an axial groove 12.2 at its upper edge 12.1, and there is a supporting plate 16 in one side of upper face cap 1.3. The top of edge 12.1 rests against supporting plate 16. Only when collar 12 is at a particular angle, specifically when supporting plate 16 can penetrate groove 12.2, can the collar be forced axially upward when coupling component 3 travels up. Collar 12 is represented in FIG. 2*a* as rotated approximately 150° out of its position in FIG. 2*a*, with groove 12.2 above supporting plate 16.

How the rotating drive mechanism illustrated in FIGS. 2, 2*a*, 2*b*, and 2*c* operates will now be described.

The helical transmission is represented at the bottom of FIG. 2 in the position it is in at the commencement of rotation. At the left, A, positioning component 5 is depicted in the position it is in upon termination of rotation but before commencement of the lifting motion. At the right, B, positioning component 5, threaded spindle 2, and the components connected to it are represented at the end of the lifting motion.

When drive cylinder 4 is charged with pressure medium through inlet 4.5, piston 4.1 will move axially, entraining coupling component 3 axially by way of piston rod 4.4. Since coupling component 3 engages threaded spindle 2 and extends through positioning component 5, threaded spindle 2 and hence takeof-shaft stub 2.1 as well will begin to rotate. Threaded spindle 2 and hence rotating post 25 will be prevented from lifting during this motion by the weight of the wing of the door and if necessary by the force of a spring, as well as by the fact that the upper edge 12.1 of collar 12 is resting against supporting plate 16. During the aforesaid rotation, collar 12 rests against axial needle bearing 14. Once the rollers 5.1 in positioning component 5 arrive in upper groove ends 5.23, any additional rotation on the part of coupling component 3 will be blocked. The upper terminating surface 1.3 of coupling component 3 simultaneously travels up to the bottom surface of the threaded cap on collar 12 and lifts it and hence rotating post 25 as well. In this phase, collar 12 is at an angle at which supporting plate 16 penetrates groove 12.2, so that rotating post 25 can be on the whole be lifted a distance a. The upper limiting position of threaded spindle 2 is dictated by the locking components and for additional security by a lift-termination stop 1.21 on drive cylinder 4 as well.

In the opposite direction, pressure medium is supplied to drive cylinder 4 through an inlet 4.6, initially lowering threaded spindle 2, whereby the lower terminal position of the spindle is again dictated by the position of collar 12 against axial needle bearing 14. This state is followed by the rotation that opens the door.

To prevent the wing of the swinging door from dropping out of the locked position when the supply of air to drive cylinder 4 is interrupted, a locking mechanism, which will be described in greater detail later herein with reference to another embodiment, can be positioned on the rotating post.

Figure 3:
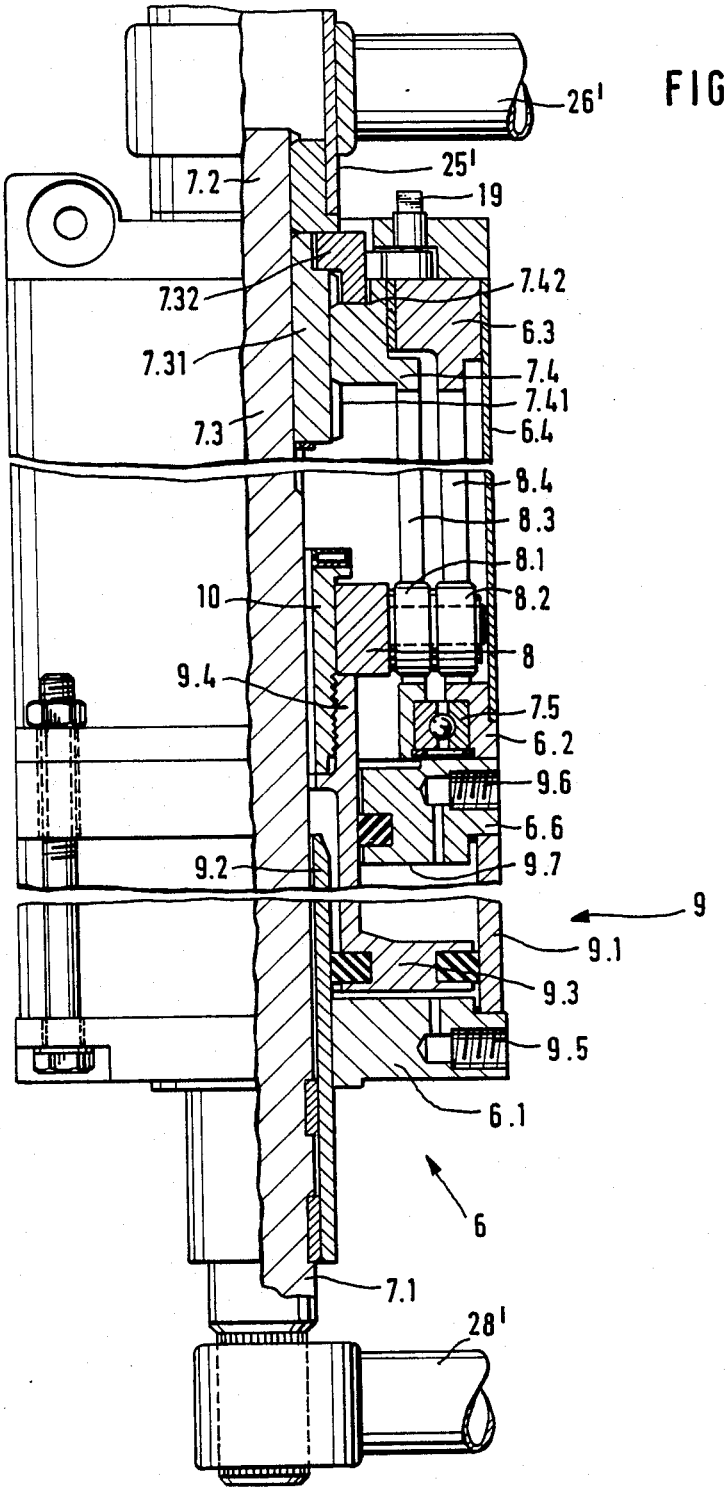
FIG. 3*c* is a section along the line III*c*—III*c* in FIG. 3*b* through a mechanism for locking the post in its terminal position.

FIGS. 3 through 3*c* illustrate a somewhat different embodiment of a rotating drive mechanism. FIG. 3 illustrates the mechanism with the door open, FIG. 3*a* the mechanism with the door closed and before it has been lifted into the locked position, and FIG. 3*b* the mechanism with the wing of the door in the limiting lifted position.

The housing 6 of the rotating drive mechanism has a face cap 6.1 and 6.3 at each end, an annular intermediate flange 6.2 in the middle, and a cylindrical jacket with grooves 8.4 that constitutes the stator and terminates at the flange. The jacket is covered by a sleeve 6.4. The bottom section, between face cap 6.1 and intermediate flange 6.2, constitutes a hollow cylinder that belongs to a drive cylinder9. Drive cylinder 9 consists of an outer jacket 9.1, an inner jacket 9.2, a base 6.1, and a cap 6.6. An annular piston 9.3 is positioned tightly between cylinder jackets 9.1 and 9.2. Its tubular piston rod 9.4 surrounds inner jacket 9.2 and extends tightly out of drive cylinder 9. at cap 6.6. Secured to the outside end of piston rod 9.4 is a coupling component 8 with pair 8.1 and 8.2 of rollers on each opposite side. The coaxially mounted rollers travel each in a positioning groove 8.3 and 8.4. Positioning groove 8.3 is in a rotor 7.4 that is non-rotationally connected to a shaft 7.3 extending coaxially through the housing 6 of the rotating drive mechanism and through the inside of inner cylinder jacket 9.2. Shaft 7.3 extends out of housing 6 at each end. The end of shaft 7.3 that is at the top in the drawing is in one piece with the stub 7.2 of a driveshaft that extends out of the housing and is in turn rigidly connected to rotating post 25', to which the upper pivoting arm 26' is secured. The roller 8.2 on coupling component 8 is positioned in another positioning groove 8.4 in the stator that is rigidly connected to face cap 6.3 and hence to the housing 6 of the rotating drive mechanism. Positioning grooves 8.3 and 8.4 are helical and have opposing pitches.

The end of shaft 7.3 that is at the bottom in the drawing is in one piece with the stub 7.1 of a driveshaft that is secured to the arm 28' that the wing of the door swings on. The design of this rotating drive mechanism accordingly differs slightly from that illustrated in FIG. 1.

Rotor 7.4 is mounted on a ball bearing 7.5 on intermediate flange 6.2. The positioning grooves are illustrated in detail in FIG. 4. Positioning groove 8.4 has an initial section 8.41 and a second section 8.42 with a slightly different pitch, varying the transmission ratio. In a final section 8.43 or 8.33 the positioning guides parallel the axis.

Shaft 7.3 is non-rotationally connected to rotor 7.4 by means of a hub 7.31 that is rigidly connected to the shaft and by means of a multiple-wedge surface 7.41 that allows the shaft to slide axially. The bottom limiting position of shaft 7.3 in relation to rotor 7.4 is dictated by the position of a nut 7.32, which is connected to hub 7.31, against the uper surface 7.42 of rotor 7.4. The upper limiting position of shaft 7.3 is dictated by a lift-termination stop 9.7 in drive cylinder 9.

When pressure medium is supplied to drive cylinder 9 through inlet 9.5, annular piston 9.3 will rise in the space between cylinder jackets 9.1 and 9.2, axially entraining rollers 8.1 and 8.2 by way of coupling component 8. The motion of rollers 8.1 and 8.2 in positioning grooves 8.3 and 8.4 rotates, due to the opposed pitch of the grooves, rotor 7.4 in relation to the stator or housing 6 of the rotating drive mechanism. Shaft 7.3 and, with it, driveshaft stubs 7.1 and 7.2 will accordingly rotate.

When rollers 8.1 and 8.2 enter the final and axially parallel sections of positioning grooves 8.3 and 8.4 as coupling component 8 travels up, further rotation of shaft 7.3 will be blocked.

Figure 3A:
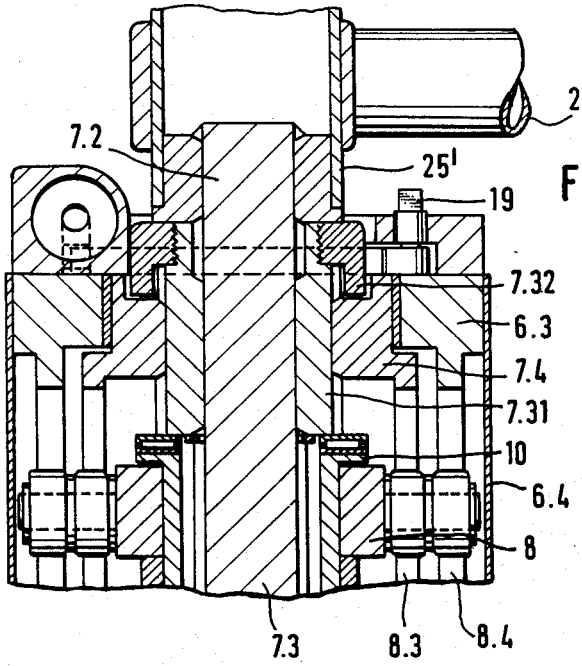
Figure 3B:
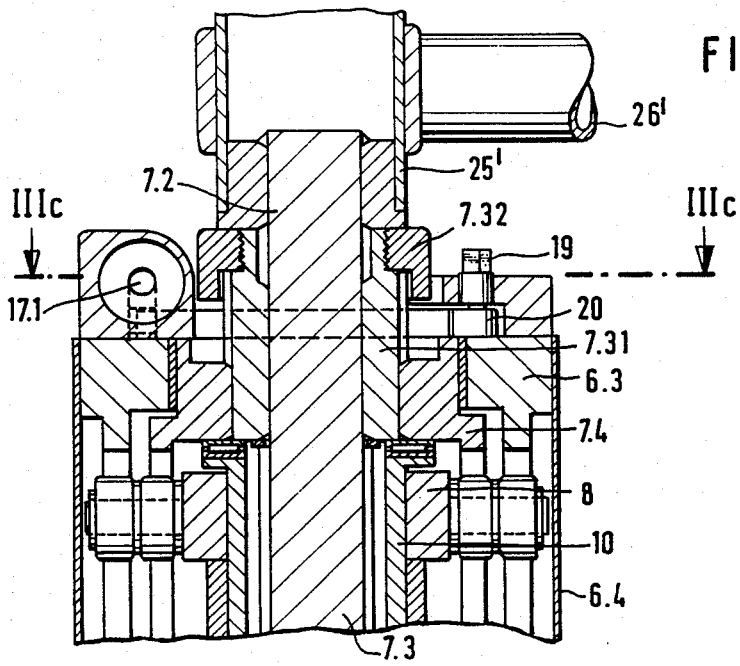

In this position, which is illustrated in FIG. 3*a*, a sleeve 10 that is connected to piston rod 9.4 rests against the bottom of hub 7.31 and, as annular piston 9.3 continues to move, shaft 7.3 and hence rotating post 25' is lifted into the lift limiting position illlustrated in FIG. 3*b* and the wing of the door is locked in place.

Shaft 7.3 is accordingly lifted without stressing rollers 8.1 and 8.2.

The direction of motion is reversed, lowering shaft 7.3 and rotating it to open the door, that is, by supplying pressure medium to the inlet 9.6 into coupling component 8.

To prevent the wing of the door from dropping and accordingly automatically unlocking when the supply of air to drive cylinder 9 is interrupted, there is a locking mechanism of the design illustrated in FIG. 3*c*. This locking mechanism has a pivoting lever 20 that, subject to a compression spring 18 presses against the bottom of nut 7.32 when shaft 7.3 is up and accordingly locks the shaft in its limiting position. Spring 18 is positioned inside an unlocking cylinder 17 associated with a piston that is connected to lever 20 by a piston rod 17.1 in such a way as to ensure pneumatic release when pressure medium is supplied to the unlocking cylinder. It is also possible to release lever 20 manually by means of a square 19 on lever 20.

What is claimed is:

1. In a rotating drive mechanism for operating a swinging door articulated on a rotating post including means for axially displacing the rotating post, when the door is closed, to move the door to a locked position wherein locking components on a stationary door frame and on the wing of the door are engaged, a mechanism providing strictly linear motion and controlled by fluid pressure is connected to a helical transmission which converts the linear motion into rotary motion to rotate the post and door, the improvement comprising means preventing rotation of the rotating post while permitting axial movement when the door is closed and means bridging the helical transmission to directly couple the linear drive mechanism to the post to lift the post when the post has attained a specified limit of rotation and the door is closed.

2. A rotating drive mechanism as in claim 1, wherein the locking components include means for solely controlling swinging of the wing, once the limiting position prescribed for the rotation has been attained with the wing of the door closed.

3. A rotating drive mechanism as in claim 1, further comprising means interlockingly coupling the rotating post to the linear drive mechanism as the rotating post is lowered.

4. A rotating drive mechanism as in claim 1, further comprising means for automatically locking the rotating post into the lift-termination position.

5. A rotating drive mechanism as in claim 4, wherein the locking means is releasable pneumatically or hydraulically.

6. A rotating drive mechanism as in claim 4, wherein the locking means is manually releasable.

7. A rotating drive mechanism as in claim 1, further comprising a housing and wherein the helical transmission has a stator rigidly connected to the housing of the rotating drive mechanism, a rotatable rotor coupled to the rotating post, and a coupling component that is connected to the linear drive mechanism slidable back and forth axially to rotate the rotor in relation to the stator, wherein the coupling means coupled the rotating post to the rotor to prevent rotation with it and permit axial movement with it and the axial coupling means directly couples the rotor to the linear drive mechanism once the couping component has attained a prescribed position while the door is closing.

8. A rotating drive mechanism as in claim 7, wherein the direct axial coupling means comprises the coupling component.

9. A rotating drive mechanism as in claim 7, wherein the direct axial coupling means comprises a takeoff component of the linear drive mechanism.

10. A rotating drive mechanism as in claim 7, further comprising a positioning structure between the stator and the rotor to ensure that the rotation is concluded before the lifting motion commences.

11. A rotating drive mechanism as in claim 4, wherein the locking means comprises an unlocking cylinder, a piston rod for the cylinder, a bar coupled to the piston rod and which pivots radially in relation to the rotating post, a stop connected to the rotating post and which engages the bar in the lift-termination position subject to the force of a spring.

* * * * *